US010173095B2

(12) United States Patent
Gomberg et al.

(10) Patent No.: US 10,173,095 B2
(45) Date of Patent: Jan. 8, 2019

(54) ADJUSTABLE REHABILITATION AND EXERCISE DEVICE

(71) Applicant: ROM3 Rehab LLC, Las Vegas, NV (US)

(72) Inventors: Sanford Gomberg, Las Vegas, NV (US); Peter Arn, Pasadena, CA (US); Jon T. Thomas, Atlanta, GA (US); Sean P. Allison, York, PA (US)

(73) Assignee: ROM3 Rehab LLC, Las Vegas, NV (US)

( * ) Notice: Subject to any disclaimer, the term of this patent is extended or adjusted under 35 U.S.C. 154(b) by 0 days.

(21) Appl. No.: 15/700,298

(22) Filed: Sep. 11, 2017

(65) Prior Publication Data

US 2018/0071566 A1 Mar. 15, 2018

Related U.S. Application Data

(60) Provisional application No. 62/393,348, filed on Sep. 12, 2016.

(51) Int. Cl.
*A63B 22/00* (2006.01)
*A63B 22/06* (2006.01)
(Continued)

(52) U.S. Cl.
CPC .... *A63B 22/0015* (2013.01); *A63B 21/00069* (2013.01); *A63B 21/015* (2013.01);
(Continued)

(58) Field of Classification Search
CPC ..... A63B 21/00069; A63B 21/015; A63B 21/225; A63B 22/0002; A63B 22/0005;
(Continued)

(56) References Cited

U.S. PATENT DOCUMENTS 59,915 A 11/1866 Lallement
363,522 A 5/1887 Knous
(Continued)

FOREIGN PATENT DOCUMENTS

CN 105620643 A 6/2016
DE 95019 1/1897
(Continued)

OTHER PUBLICATIONS

"ROM3 Rehab System" uploaded by ROM3 Rehab, Apr. 20, 2015 [retrieved Aug. 31, 2018]. Retrieved from the Internet: <https://vimeo.com/125438463>.*
(Continued)

*Primary Examiner* — Joshua Lee
(74) *Attorney, Agent, or Firm* — Luedeka Neely Group, PC

(57) ABSTRACT

An adjustable rehabilitation and exercise device, including a rotary member rotatable on a hub and having a plurality of elongated and spaced apart elongated mount receivers defined thereon; a mount selectively and movably positionable on a selected one of the mount receivers of the rotary member to select an angular location of the mount, the mount including a sliding member movably positionable along the selected mount receiver to a selected radial location along the selected mount receiver to select a radial location of the mount relative to the hub; and a patient engagement member connectable to the mount and movable with the mount.

6 Claims, 3 Drawing Sheets

(51) Int. Cl.

| | |
|---|---|
| ***A63B 21/00*** | (2006.01) |
| ***A63B 21/015*** | (2006.01) |
| ***A63B 69/16*** | (2006.01) |
| *A63B 21/22* | (2006.01) |

(52) U.S. Cl.
CPC ..... *A63B 22/0002* (2013.01); *A63B 22/0046* (2013.01); *A63B 22/0605* (2013.01); *A63B 69/16* (2013.01); *A63B 21/225* (2013.01); *A63B 22/0005* (2015.10); *A63B 22/0007* (2013.01); *A63B 2022/0611* (2013.01); *A63B 2022/0623* (2013.01); *A63B 2022/0635* (2013.01); *A63B 2069/161* (2013.01); *A63B 2220/30* (2013.01); *A63B 2225/09* (2013.01)

(58) Field of Classification Search
CPC ..... A63B 22/0007; A63B 22/0015; A63B 22/0046; A63B 22/0605; A63B 69/16; A63B 2022/0611; A63B 2022/0623; A63B 2022/0635; A63B 2069/161; A63B 2220/30; A63B 2225/09
See application file for complete search history.

(56) References Cited

U.S. PATENT DOCUMENTS

| | | | |
|---|---|---|---|
| 446,671 | A | 2/1891 | Elliott |
| 610,157 | A | 8/1898 | Campbell |
| 631,276 | A | 8/1899 | Bulova |
| 823,712 | A | 6/1906 | Uhlmann |
| 1,149,029 | A | 8/1915 | Clark |
| 1,227,743 | A | 5/1917 | Burgedorff |
| 1,784,230 | A | 12/1930 | Freeman |
| 3,081,645 | A | 3/1963 | Bergfors |
| 3,100,640 | A | 8/1963 | Weitzel |
| 3,137,014 | A | 6/1964 | Meucci |
| 3,143,316 | A | 8/1964 | Shapiro |
| 3,713,438 | A | 1/1973 | Knutsen |
| 3,888,136 | A | 6/1975 | Lapeyre |
| 4,079,957 | A | 3/1978 | Blease |
| 4,446,753 | A | 5/1984 | Nagano |
| 4,477,072 | A | 10/1984 | DeCloux |
| 4,509,742 | A | 4/1985 | Cones |
| 4,606,241 | A | 8/1986 | Fredriksson |
| 4,611,807 | A | 9/1986 | Castillo |
| 4,648,287 | A | 3/1987 | Preskitt |
| 4,673,178 | A | 6/1987 | Dwight |
| 4,850,245 | A | 7/1989 | Feamster et al. |
| 4,858,942 | A | 8/1989 | Rodriguez |
| 4,915,374 | A | 4/1990 | Watkins |
| 4,930,768 | A | 6/1990 | Lapcevic |
| 4,961,570 | A | 10/1990 | Chang |
| 5,027,794 | A | 7/1991 | Pyle |
| 5,161,430 | A | 11/1992 | Febey |
| 5,247,853 | A | 9/1993 | Dalebout |
| D342,299 | S | 12/1993 | Birrell et al. |
| 5,282,748 | A | 2/1994 | Little |
| 5,316,532 | A | 5/1994 | Butler |
| 5,324,241 | A | 6/1994 | Artigues et al. |
| 5,336,147 | A | 8/1994 | Sweeney |
| 5,338,272 | A | 8/1994 | Sweeney |
| 5,361,649 | A | 11/1994 | Slocum |
| 5,458,022 | A | 10/1995 | Mattfeld et al. |
| 5,566,589 | A | 10/1996 | Buck |
| 5,580,338 | A | 12/1996 | Scelta et al. |
| 5,676,349 | A | 10/1997 | Wilson |
| 5,685,804 | A | 11/1997 | Whan-Tong et al. |
| 5,860,941 | A | 1/1999 | Saringer et al. |
| 5,950,813 | A | 9/1999 | Hoskins et al. |
| 6,053,847 | A | 4/2000 | Stearns et al. |
| 6,077,201 | A | 6/2000 | Cheng |
| 6,102,834 | A | 8/2000 | Chen |
| 6,155,958 | A | 12/2000 | Goldberg |
| 6,253,638 | B1 | 7/2001 | Bermudez |
| 6,371,891 | B1 | 4/2002 | Speas |
| 6,430,436 | B1 | 8/2002 | Richter |
| 6,474,193 | B1 | 11/2002 | Farney |
| 6,543,309 | B2 | 4/2003 | Heim |
| 6,589,139 | B1 | 7/2003 | Butterworth |
| 6,640,662 | B1 | 11/2003 | Baxter |
| 6,820,517 | B1 | 11/2004 | Farney |
| 6,865,969 | B2 | 3/2005 | Stevens |
| 6,895,834 | B1 | 5/2005 | Baatz |
| 7,226,394 | B2 | 6/2007 | Johnson |
| 7,594,879 | B2 | 9/2009 | Johnson |
| 9,044,630 | B1 | 6/2015 | Lampert et al. |
| 9,480,873 | B2 | 11/2016 | Chuang |
| 2003/0092536 | A1 | 5/2003 | Romanelli et al. |
| 2004/0194572 | A1 | 10/2004 | Kim |
| 2005/0020411 | A1 | 1/2005 | Andrews |
| 2005/0085353 | A1 | 4/2005 | Johnson |
| 2005/0274220 | A1 | 12/2005 | Reboullet |
| 2006/0003871 | A1 | 1/2006 | Houghton et al. |
| 2008/0161166 | A1 | 7/2008 | Lo |
| 2009/0211395 | A1 | 8/2009 | Mul'e |
| 2012/0167709 | A1 | 7/2012 | Chen et al. |
| 2017/0113092 | A1 | 4/2017 | Johnson |

FOREIGN PATENT DOCUMENTS

| | | | |
|---|---|---|---|
| DE | 7628633 | U1 | 12/1977 |
| DE | 8519150 | U1 | 10/1985 |
| DE | 3732905 | A1 | 7/1988 |
| DE | 29620008 | U1 | 2/1997 |
| DE | 19619820 | C2 | 1/2001 |
| DE | 19947926 | A3 | 4/2001 |
| EP | 0199600 | A2 | 10/1986 |
| EP | 0634319 | B1 | 10/1999 |
| EP | 1034817 | A1 | 9/2000 |
| FR | 2527541 | A2 | 12/1983 |
| GB | 141664 | A | 11/1920 |
| GB | 2336140 | A | 10/1999 |
| GB | 2372459 | A | 8/2002 |
| WO | 9809687 | A1 | 3/1998 |
| WO | 2006012694 | A1 | 2/2006 |

OTHER PUBLICATIONS

PCT International Search Report and Written Opinion, PCT/US17/50895 dated Jan. 12, 2018.

* cited by examiner

ADJUSTABLE REHABILITATION AND EXERCISE DEVICE

CROSS-REFERENCE TO RELATED APPLICATION

This application claims priority to U.S. Provisional Application No. 62/393,348 filed Sep. 12, 2016, entitled ADJUSTABLE REHABILITATION AND EXERCISE DEVICE, incorporated herein by reference in its entirety.

FIELD

This disclosure relates to the field of rehabilitation devices. More particularly, this disclosure relates to adjustable rehabilitation devices having improved connection and adjustability of patient engagement members.

BACKGROUND

Improvement is desired in the construction of adjustable rehabilitation and exercise devices. Adjustable rehabilitation and exercise devices having pedals on opposite sides and adjustably positionable pedals have been proposed. However, such designs require improvement due to the fact that the pedals tend to not remain securely mounted and detach, wobble and the like.

Accordingly, in one aspect, the disclosure provides an adjustable rehabilitation and exercise device having patient engagement members on opposite sides of the device, which are adjustably positionable both radially and angularly in a secure and stable manner.

SUMMARY

The disclosure provides an adjustable rehabilitation and exercise devices.

In one aspect, an adjustable rehabilitation and exercise device includes a rotary member rotatably on a hub and having a plurality of elongated and spaced apart elongated mount receivers defined thereon; a mount selectively and movably positionable on a selected one of the mount receivers of the rotary member to select an angular location of the mount, the mount including a sliding member movably positionable along the selected mount receiver to a selected radial location along the selected mount receiver to select a radial location of the mount relative to the hub; and a patient engagement member connectable to the mount and movable with the mount.

In another aspect, an adjustable rehabilitation and exercise device includes a rotary member rotatable on a hub and having a plurality of elongated and spaced apart elongated mount receivers defined thereon, the mount receivers each comprising an elongated track located on the rotary member and a row of pegs located on the rotary member along the length of the track; a mount selectively and movably positionable on a selected one of the mount receivers of the rotary member to select an angular location of the mount, the mount including a sliding member movably positionable along the selected mount receiver to a selected radial location along the selected mount receiver to select a radial location of the mount relative to the hub, the mount comprising a slide member configured to slidingly engage the track and a movable plunger located on the slide member, wherein the plunger is movable to engage the slot so as to lock the position of the mount along the track; and a patient engagement member connectable to the mount and movable with the mount.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
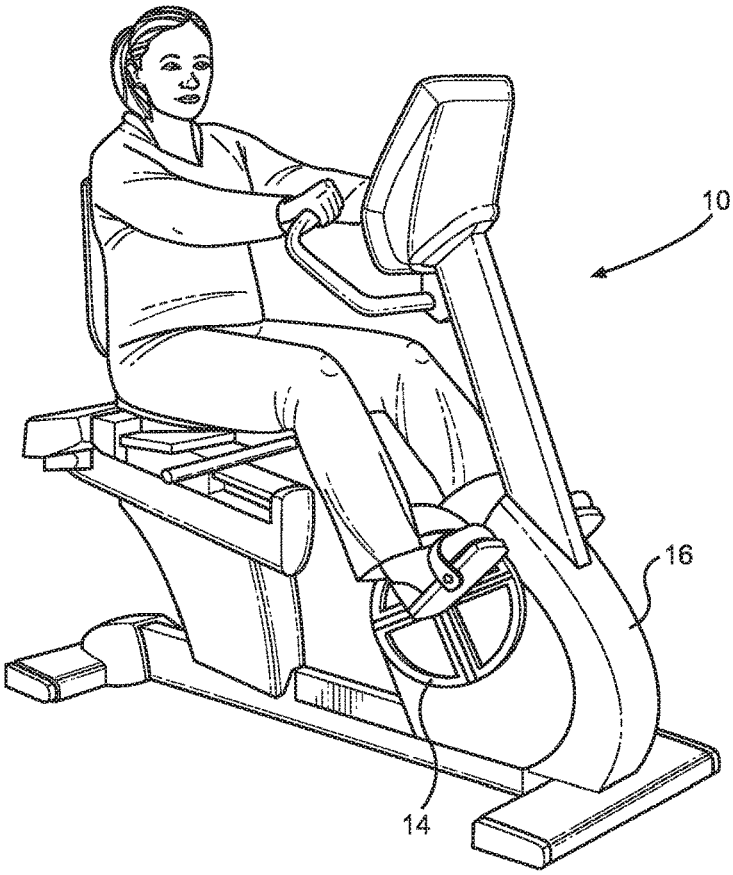
FIGS. 1A and 1B are perspective views of an adjustable rehabilitation and exercise device according to the disclosure configured to have adjustably positionable patient engagement members.
Figure 1B:
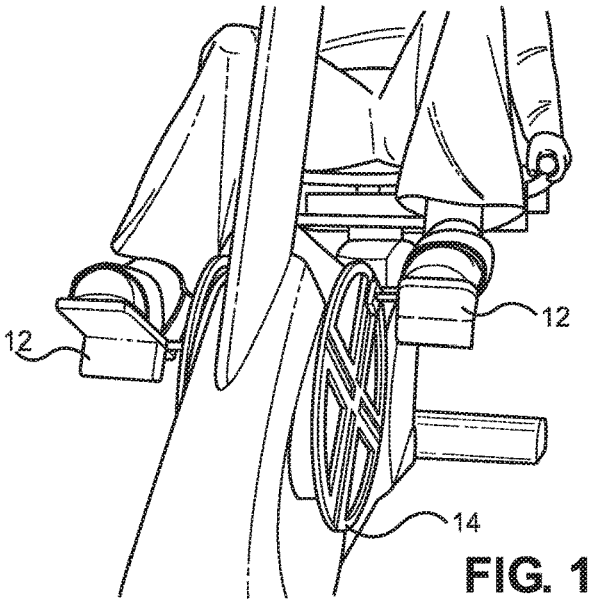

With initial reference to FIGS. 1A-1B, there is shown an adjustable rehabilitation and exercise device 10 having patient engagement members, such as pedals 12 on opposite sides that are adjustably positionable relative to one another, but securely mounted according to the disclosure to provide a more secure mounting that avoids disconnection, wobbling and the like often experienced with prior devices.

The device 10 includes a rotary device such as a wheel 14 or flywheel or the like rotatably mounted such as by a central hub to a frame 16 or other support. The pedal 12 is configured for interacting with a patient to be rehabilitated and may be configured for use with lower body extremities such as the feet, legs, or upper body extremities such as the hands, arms, and the like. For example, the pedal 12 may be a conventional bicycle pedal of the type having a foot support rotatably mounted onto an axle with bearings. The axle has exposed end threads for engaging a mount on the wheel 14 to locate the pedal on the wheel 14.

The wheel 14 may be configured to have both pedals 12 on opposite sides of a single wheel. However, a preferred construction, as seen in FIGS. 1A and 1B shows a pair of the wheels 14 spaced apart from one another but interconnected to a flywheel or the like.

The rehabilitation and exercise device 10 of FIGS. 1A-1B may take the form as depicted of a traditional exercise/rehabilitation device which is more or less non-portable and remains in a fixed location, such as a rehabilitation clinic or medical practice.

Alternatively, the device 10 may be configured to be smaller and more portable unit so that it is able to be easily transported to different locations at which rehabilitation or treatment is to be provided, such as a plurality of patient's homes, alternative care facilities or the like.

Figure 2A:
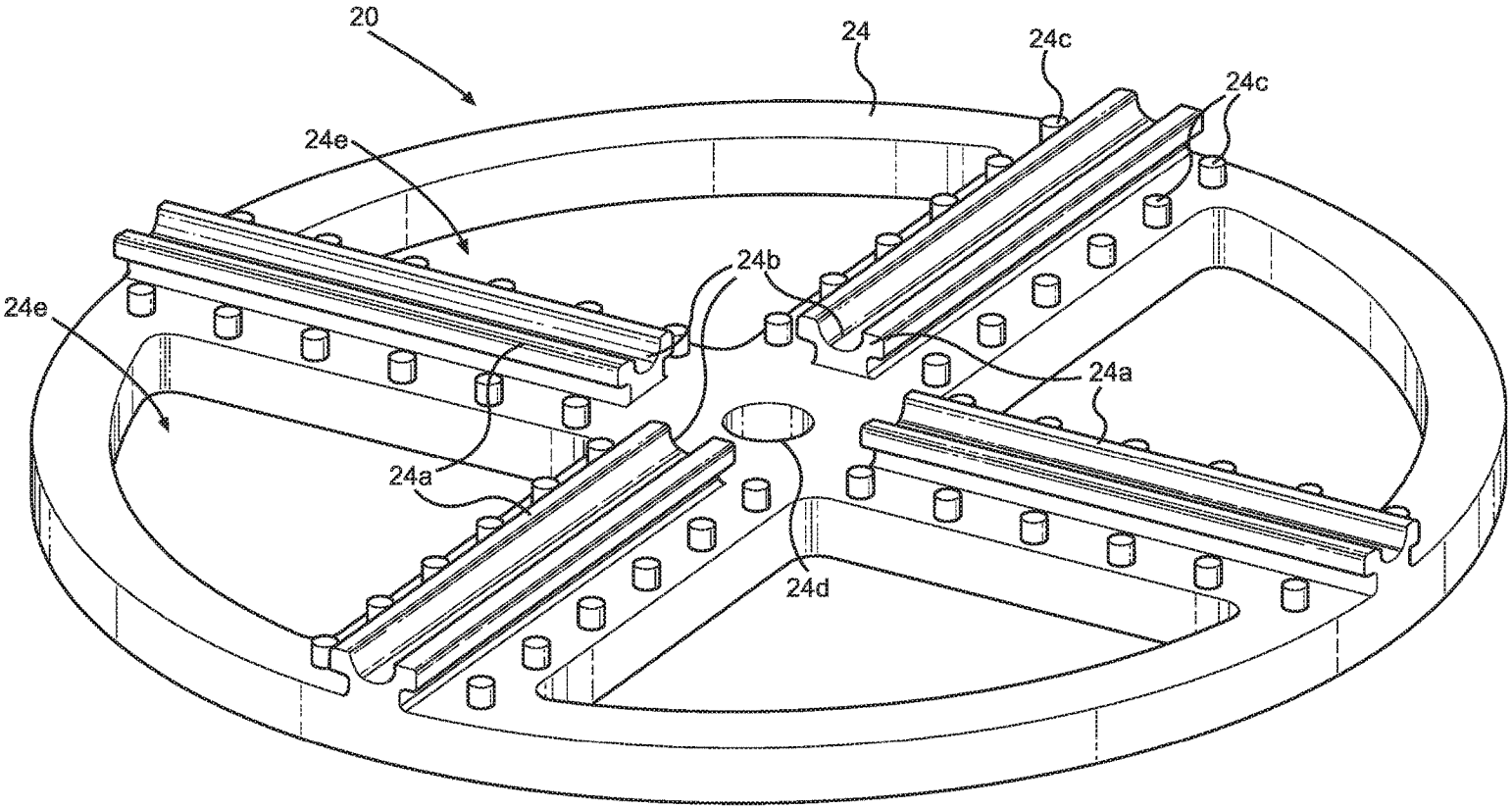
FIGS. 2A-2C show a wheel system for adjustably positioning a patient engagement member.
Figure 2B:
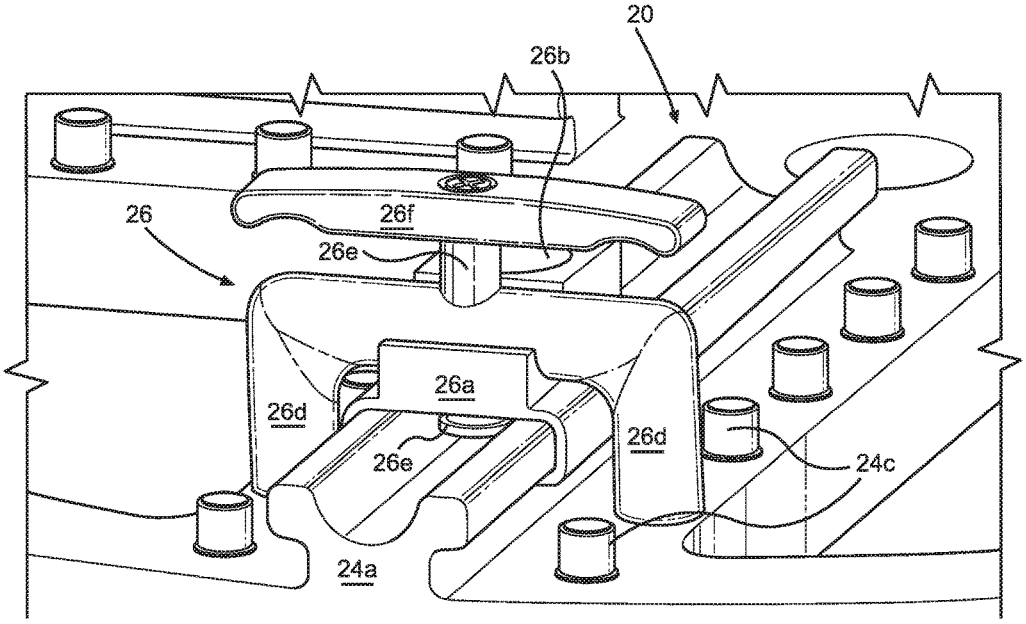
Figure 2C:
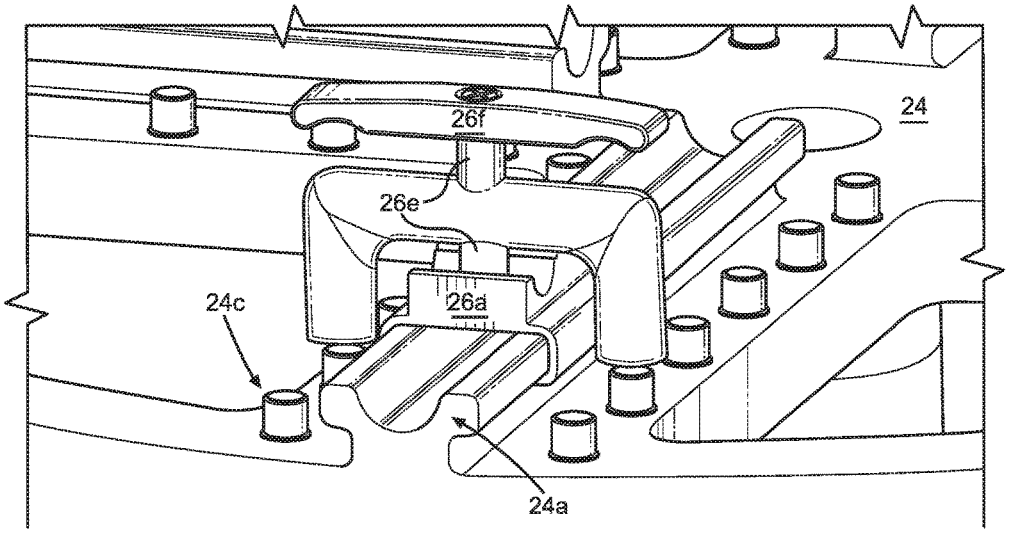

With reference to FIGS. 2A-2C, there is shown a wheel system 20 configured to have a patient engagement member, such as a pedal adjustably mounted on a wheel 24 by an adjustable mount 26. It will be appreciated that the patient engagement member may be configured to engage a hand or foot or other member of a patient as may be desired for rehabilitation. The pedal may be a conventional pedal and includes a support rotatably mounted on an axle having exposed threads for being received by a corresponding threaded aperture of the mount 26. It will be appreciated that a pair of the wheels 24 may be utilized or, alternatively, a single one of the wheels 24 with a mount and pedal on each side.

The wheel 24 is a disk configured to include a plurality of spaced apart elongated elevated tracks 24*a* formed on the wheel 24 to receive the mount 26. The tracks 24*a* include a U-shaped interior channel 24*b*, and a plurality of uniformly spaced raised pegs 24*c* along both sides of the length of the bridges 24*a*. The tracks 24*a* may be open at each end to facilitate installation and removal of the mount 26.

The wheel 24 also includes a hub or central mounting aperture 24*d* for rotatably mounting of the wheel 24, such as to the device 10. Material of the wheel 24 may be removed to provide openings 24*e* to provide aesthetics and for reducing the weight and the cost of the wheel 24.

The mount 26 includes a slide member 26*a* configured to slidingly engage the track 24*a*. The slide member 26*a* preferably wraps around portions of the track 24*a* and includes an outward facing receiver 26*b* to which a patient engagement member, such as a pedal, may be connected. The mount 26 also includes a tower 26*c* having a pair of spaced apart hollow cylindrical legs 26*d*. A spring-loaded plunger 26*e* having a handle 26*f* is mounted to a central portion of the tower 26*c*.

The mount 26 is shown locked or secured in FIG. 2B, with the legs 26*d* seated onto the pegs 24*c* at a radial location on the wheel 24 relative to the central mounting aperture 24*d* which serves to locate the hub to define a rotational axis. As shown in FIG. 2B, the spring-loaded plunger 26*e* applies force to the channel 24*b* to seat the legs 26*d* on the pegs 24*c* and otherwise securely locate the mount 26 onto the track 24*a*.

FIG. 2C shows the plunger 26*e* released, as by pulling upward on the handle 26*f* The tower 26*c* may then be lifted to move the slide member 26*a* and position it so the legs 26*d* are seated on a pair of the pegs 24*c* corresponding to a different radial location. Once the mount 26 is relocated with the legs 26*d* seated onto a different pair of the pegs 24*c* at a desired position, the handle 26*f* is released to reapply the plunger 26*e* and securely locate the mount 26 at the new radial location on the wheel 24.

The mount 26 is configured to stably locate a pedal or other patient engagement member and eliminate wobble and the like associated with conventional devices. In addition, the mount 26 is also configured to advantageously enable substantially incremental adjustment of the position of the mount.

The mount 26 cooperates with the track 24*a* to adjustably position the mount 26, and hence the pedal, relative to the hub on which the wheel 24 rotates. Further, the availability of a plurality of tracks 24*a* enables a user to select which track 24*a* for installation of the mount 26. Thus, in combination, the mount 26 and the tracks 24*a* enable radial and angular adjustment of the position of the pedal or other patient engagement member. When this manner of adjustment is used for both of the pedals on opposite sides of the device 10, it will be appreciated that the pedals, or other patient engagement members, may each be adjustably positioned radially relative to the hub on which the wheels rotate, and angularly relative to one another.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure.

The invention claimed is:

1. An adjustable rehabilitation and exercise device, comprising:

a rotary member rotatably mounted on a hub and having a plurality of elongated and spaced apart mount receivers defined thereon;

a mount selectively and movably positionable on a selected one of the mount receivers of the rotary member to select an angular location of the mount, the mount including a sliding member movably positionable along the selected mount receiver to a selected radial location along the selected mount receiver to select a radial location of the mount relative to the hub; and a patient engagement member connectable to the mount and movable with the mount;

wherein each of the mount receivers comprises an elongated track located on the rotary member and a row of pegs located on the rotary member along the length of the track, and the mount comprises a slide member configured to slidingly engage the track, and a hollow leg operatively associated with a movable plunger, wherein the hollow leg is selectively positionable on one of the pegs and the plunger is movable to engage the track so as to lock the position of the mount along the track.

2. The device of claim 1, wherein each of the mount receivers comprises two rows of pegs and the mount comprises a pair of hollow legs configured to seat over a pair of the pegs.

3. The device of claim 2, wherein the hollow legs form a tower to which the plunger is connected to by a handle.

4. An adjustable rehabilitation and exercise device, comprising:

a rotary member rotatably mounted on a hub and having a plurality of elongated and spaced apart mount receivers defined thereon, the mount receivers each comprising an elongated track located on the rotary member and a row of pegs located on the rotary member along the length of the track;

a mount selectively and movably positionable on a selected one of the mount receivers of the rotary member to select an angular location of the mount, the mount including a sliding member movably positionable along the selected mount receiver to a selected radial location along the selected mount receiver to select a radial location of the mount relative to the hub, the mount comprising a slide member configured to slidingly engage the track and a movable plunger located on the slide member, wherein the plunger is movable to engage the slot so as to lock the position of the mount along the track; and a patient engagement member connectable to the mount and movable with the mount.

5. The device of claim 4, wherein each of the mount receivers comprises two rows of pegs and the mount comprises a pair of hollow legs configured to seat over a pair of the pegs.

6. The device of claim 5, wherein the hollow legs form a tower to which the plunger is connected to by a handle.

* * * * *